US011735829B2

(12) United States Patent
Harel

(10) Patent No.: US 11,735,829 B2
(45) Date of Patent: Aug. 22, 2023

(54) COMPACT MODULAR ACTIVE-PASSIVE ANTENNA SYSTEMS WITH MINIMIZED ANTENNA BLOCKAGE

(71) Applicant: Nokia Shanghai Bell Co., Ltd, Shanghai (CN)

(72) Inventor: Jeanpierre Harel, Lannion (FR)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 0 days.

(21) Appl. No.: 17/993,021

(22) Filed: Nov. 23, 2022

(65) Prior Publication Data

US 2023/0163483 A1 May 25, 2023

(30) Foreign Application Priority Data

Nov. 25, 2021 (FI) ..... 20216209

(51) Int. Cl.
*H01Q 21/06* (2006.01)
*H01Q 19/02* (2006.01)
*H01Q 1/22* (2006.01)

(52) U.S. Cl.
CPC ..... *H01Q 21/065* (2013.01); *H01Q 1/2283* (2013.01); *H01Q 19/021* (2013.01)

(58) Field of Classification Search
CPC .. H01Q 21/065; H01Q 1/2283; H01Q 19/021; H01Q 1/246; H01Q 1/42; H01Q 5/48; H01Q 21/0025; H01Q 21/26
See application file for complete search history.

(56) References Cited

U.S. PATENT DOCUMENTS

2021/0305683 A1* 9/2021 Hou ..... H01Q 21/26

FOREIGN PATENT DOCUMENTS

EP 3 886 333 A1 9/2021
WO WO-2021/195040 A2 9/2021

* cited by examiner

*Primary Examiner* — Dieu Hien T Duong
(74) *Attorney, Agent, or Firm* — Harrington & Smith

(57) ABSTRACT

According to an aspect, there is provided a passive antenna module for an active-passive antenna system. The passive antenna module includes a chassis for detachably mounting onto an active antenna module. The chassis includes an opening or a cavity for extending at least partially over the active antenna module when the chassis is mounted onto the active antenna module. The passive antenna module includes a ground plane layer arranged within or over said opening or cavity and fixed to the chassis. The ground plane layer includes a metallic or metallized grid. The passive antenna module includes a first antenna array including one or more first antenna elements arranged, in part, over said chassis and adjacent to said opening or cavity and, in part, over said opening or cavity. The chassis and the ground plane layer are adapted to act as ground planes for the first antenna array.

13 Claims, 6 Drawing Sheets

COMPACT MODULAR ACTIVE-PASSIVE ANTENNA SYSTEMS WITH MINIMIZED ANTENNA BLOCKAGE

TECHNICAL FIELD

Various embodiments relate generally to antennas, and more particularly to active-passive antennas.

BACKGROUND ART

Active-Passive Antennas (APAs) (or equally APA systems) are multiband passive antennas which integrate 5G active features. APAs are used, e.g., in 5G base stations. Typically, APAs are antenna systems which integrate (5G) active massive MIMO antennas (i.e., massive antenna arrays or panels integrated with radio transceiver elements to form a single unit) with (4G or lower) passive antennas. The electronics, radio frequency components and chassis are shared between the active and passive antennas of the APA. Such an arrangement provides multiple benefits such as reduced bill of materials, lowered overall weight and reduced overall wind load. Some present APA solutions employ modular structures where the passive and/or active parts of the APA form separate but electrically (and physically) connected modules which may be independently removable and replaceable, even "in the field" (i.e., on site). However, the process of replacing said modules of the APA is often complicated and time consuming as this requires, first, removing all RF connections between the active and passive antenna modules. For example, in some solutions, the passive antenna module is not be detachable as a single part, but must, before detaching, be split into multiple smaller parts. There is a need for APA solutions enabling simple replacement of the active and/or passive antenna module of the APA even in the field while still maintaining the benefit of the compact form factor of known modular APA systems. This goal should be achieved such that the active and passive antenna modules do not cause significant blockage to each other even when beam scanning/forming is carried out.

BRIEF DESCRIPTION

According to an aspect, there is provided the subject matter of the independent claims. Embodiments are defined in the dependent claims.

One or more examples of implementations are set forth in more detail in the accompanying drawings and the description below. Other features will be apparent from the description and drawings, and from the claims.

Some embodiments provide a passive antenna module for an active-passive antenna system and an active-passive antenna system.

BRIEF DESCRIPTION OF THE DRAWINGS

In the following, some example embodiments will be described with reference to the accompanying drawings, in which.

DETAILED DESCRIPTION OF SOME EMBODIMENTS

The following embodiments are exemplary. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments.

In the following, different exemplifying embodiments will be described using, as an example of an access architecture to which the embodiments may be applied, a radio access architecture based on long term evolution advanced (LTE Advanced, LTE-A) or new radio (NR, 5G), without restricting the embodiments to such an architecture, however. It is obvious for a person skilled in the art that the embodiments may also be applied to other kinds of communications networks having suitable means by adjusting parameters and procedures appropriately. Some examples of other options for suitable systems are the universal mobile telecommunications system (UMTS) radio access network (UTRAN or E-UTRAN), long term evolution (LTE, the same as E-UTRA), wireless local area network (WLAN or WiFi), worldwide interoperability for microwave access (WiMAX), Bluetooth®, personal communications services (PCS), ZigBee®, wideband code division multiple access (WCDMA), systems using ultra-wideband (UWB) technology, sensor networks, mobile ad-hoc networks (MANETs) and Internet Protocol multimedia subsystems (IMS) or any combination thereof.

Figure 1:
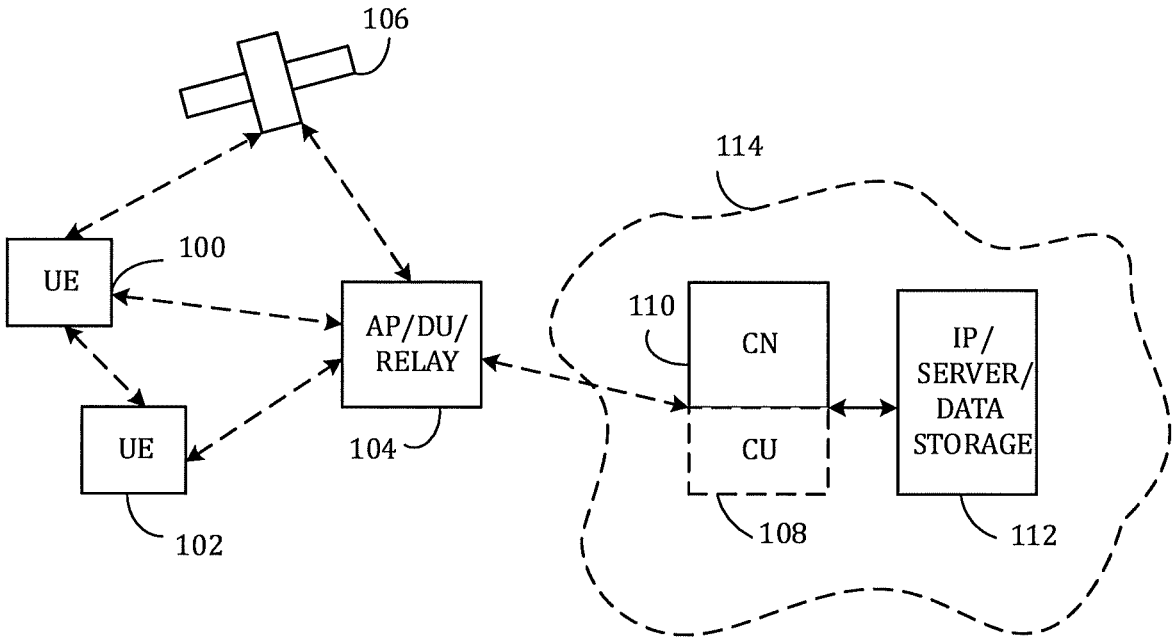
FIG. 1 illustrates an example of a communications system to which embodiments may be applied.

FIG. 1 depicts examples of simplified system architectures only showing some elements and functional entities, all being logical units, whose implementation may differ from what is shown. The connections shown in FIG. 1 are logical connections; the actual physical connections may be different. It is apparent to a person skilled in the art that the system typically comprises also other functions and structures than those shown in FIG. 1.

The embodiments are not, however, restricted to the system given as an example but a person skilled in the art may apply the solution to other communication systems provided with necessary properties.

The example of FIG. 1 shows a part of an exemplifying radio access network.

FIG. 1 shows user devices 100 and 102 configured to be in a wireless connection on one or more communication channels in a cell with an access node (such as (e/g)NodeB) 104 providing the cell. The physical link from a user device to a (e/g)NodeB is called uplink or reverse link and the physical link from the (e/g)NodeB to the user device is called downlink or forward link. It should be appreciated that (e/g)NodeBs or their functionalities may be implemented by using any node, host, server or access point etc. entity suitable for such a usage.

A communications system typically comprises more than one (e/g)NodeB in which case the (e/g)NodeBs may also be configured to communicate with one another over links, wired or wireless, designed for the purpose. These links may be used for signaling purposes. The (e/g)NodeB is a computing device configured to control the radio resources of communication system it is coupled to. The NodeB may also be referred to as a base station, an access point, an access node or any other type of interfacing device including a relay station capable of operating in a wireless environment. The (e/g)NodeB includes or is coupled to transceivers. From the transceivers of the (e/g)NodeB, a connection is provided to an antenna unit that establishes bi-directional radio links to user devices. The antenna unit may comprise a plurality of antennas or antenna elements (possible forming an antenna array). The (e/g)NodeB is further connected to core network 110 (CN or next generation core NGC). Depending on the system, the counterpart on the CN side can be a serving gateway (S-GW, routing and forwarding user data packets), packet data network gateway (P-GW), for providing connectivity of user devices (UEs) to external packet data networks, or mobile management entity (MME), etc.

The user device (also called UE, user equipment, user terminal, terminal device, etc.) illustrates one type of an apparatus to which resources on the air interface are allocated and assigned, and thus any feature described herein with a user device may be implemented with a corresponding apparatus, such as a relay node. An example of such a relay node is a layer 3 relay (self-backhauling relay) towards the base station.

The user device typically refers to a portable computing device that includes wireless mobile communication devices operating with or without a subscriber identification module (SIM), including, but not limited to, the following types of devices: a mobile station (mobile phone), smartphone, personal digital assistant (PDA), handset, device using a wireless modem (alarm or measurement device, etc.), laptop and/or touch screen computer, tablet, game console, notebook, and multimedia device. It should be appreciated that a user device may also be a nearly exclusive uplink only device, of which an example is a camera or video camera loading images or video clips to a network. A user device may also be a device having capability to operate in Internet of Things (IoT) network which is a scenario in which objects are provided with the ability to transfer data over a network without requiring human-to-human or human-to-computer interaction. The user device may also utilize cloud. In some applications, a user device may comprise a small portable device with radio parts (such as a watch, earphones or eyeglasses) and the computation is carried out in the cloud. The user device (or in some embodiments a layer 3 relay node) is configured to perform one or more of user equipment functionalities. The user device may also be called a subscriber unit, mobile station, remote terminal, access terminal, user terminal or user equipment (UE) just to mention but a few names or apparatuses.

Various techniques described herein may also be applied to a cyber-physical system (CPS) (a system of collaborating computational elements controlling physical entities). CPS may enable the implementation and exploitation of massive amounts of interconnected ICT (information and communications technology) devices (sensors, actuators, processors microcontrollers, etc.) embedded in physical objects at different locations. Mobile cyber physical systems, in which the physical system in question has inherent mobility, are a subcategory of cyber-physical systems. Examples of mobile physical systems include mobile robotics and electronics transported by humans or animals.

Additionally, although the apparatuses have been depicted as single entities, different units, processors and/or memory units (not all shown in FIG. 1) may be implemented.

5G enables using multiple input—multiple output (MIMO) antennas, many more base stations or nodes than the LTE (a so-called small cell concept), including macro sites operating in co-operation with smaller stations and employing a variety of radio technologies depending on service needs, use cases and/or spectrum available. 5G mobile communications supports a wide range of use cases and related applications including video streaming, augmented reality, different ways of data sharing and various forms of machine type applications (such as (massive) machine-type communications (mMTC), including vehicular safety, different sensors and real-time control. 5G is expected to have multiple radio interfaces, namely below 6 GHz, cmWave and mmWave, and also being integradable with existing legacy radio access technologies, such as the LTE. Integration with the LTE may be implemented, at least in the early phase, as a system, where macro coverage is provided by the LTE and 5G radio interface access comes from small cells by aggregation to the LTE. In other words, 5G is planned to support both inter-RAT operability (such as LTE-5G) and inter-RI operability (inter-radio interface operability, such as below 6 GHz—cmWave, below 6 GHz-cmWave-mmWave). One of the concepts considered to be used in 5G networks is network slicing in which multiple independent and dedicated virtual sub-networks (network instances) may be created within the same infrastructure to run services that have different requirements on latency, reliability, throughput and mobility.

The current architecture in LTE networks is fully distributed in the radio and fully centralized in the core network. The low latency applications and services in 5G require to bring the content close to the radio which leads to local break out and multi-access edge computing (MEC). 5G enables analytics and knowledge generation to occur at the source of the data. This approach requires leveraging resources that may not be continuously connected to a network such as laptops, smartphones, tablet computers and sensors. MEC provides a distributed computing environment for application and service hosting. It also has the ability to store and process content in close proximity to cellular subscribers for faster response time. Edge computing covers a wide range of technologies such as wireless sensor networks, mobile data acquisition, mobile signature analysis, cooperative distributed peer-to-peer ad hoc networking and processing also classifiable as local cloud/fog computing and grid/mesh computing, dew computing, mobile edge computing, cloudlet, distributed data storage and retrieval, autonomic self-healing networks, remote cloud services, augmented and virtual reality, data caching, Internet of Things (massive connectivity and/or latency critical), critical communications (autonomous vehicles, traffic safety, real-time analytics, time-critical control, healthcare applications).

The communication system is also able to communicate with other networks, such as a public switched telephone network or the Internet 112, or utilize services provided by them. The communication system may also be able to support the usage of cloud services, for example at least part of core network operations may be carried out as a cloud service (this is depicted in FIG. 1 by "cloud" 114). The communication system may also comprise a central control entity, or a like, providing facilities for networks of different operators to cooperate for example in spectrum sharing.

Edge cloud may be brought into radio access network (RAN) by utilizing network function virtualization (NFV) and software defined networking (SDN). Using edge cloud may mean access node operations to be carried out, at least partly, in a server, host or node operationally coupled to a remote radio head or base station comprising radio parts. It is also possible that node operations will be distributed among a plurality of servers, nodes or hosts. Application of cloudRAN architecture enables RAN real time functions being carried out at the RAN side (in a distributed unit, DU 104) and non-real time functions being carried out in a centralized manner (in a centralized unit, CU 108).

It should also be understood that the distribution of labor between core network operations and base station operations may differ from that of the LTE or even be non-existent. Some other technology advancements probably to be used are Big Data and all-IP, which may change the way networks are being constructed and managed. 5G (or new radio, NR) networks are being designed to support multiple hierarchies, where MEC servers can be placed between the core and the base station or nodeB (gNB). It should be appreciated that MEC can be applied in 4G networks as well.

5G may also utilize satellite communication to enhance or complement the coverage of 5G service, for example by providing backhauling. Possible use cases are providing service continuity for machine-to-machine (M2M) or Internet of Things (IoT) devices or for passengers on board of vehicles, or ensuring service availability for critical communications, and future railway/maritime/aeronautical communications. Satellite communication may utilize geostationary earth orbit (GEO) satellite systems, but also low earth orbit (LEO) satellite systems, in particular mega-constellations (systems in which hundreds of (nano) satellites are deployed). Each satellite 106 in the mega-constellation may cover several satellite-enabled network entities that create on-ground cells. The on-ground cells may be created through an on-ground relay node 104 or by a gNB located on-ground or in a satellite.

It is obvious for a person skilled in the art that the depicted system is only an example of a part of a radio access system and in practice, the system may comprise a plurality of (e/g)NodeBs, the user device may have an access to a plurality of radio cells and the system may comprise also other apparatuses, such as physical layer relay nodes or other network elements, etc. At least one of the (e/g)NodeBs may be a Home (e/g)nodeB. Additionally, in a geographical area of a radio communication system a plurality of different kinds of radio cells as well as a plurality of radio cells may be provided. Radio cells may be macro cells (or umbrella cells) which are large cells, usually having a diameter of up to tens of kilometers, or smaller cells such as micro-, femto- or picocells. The (e/g)NodeBs of FIG. 1 may provide any kind of these cells. A cellular radio system may be implemented as a multilayer network including several kinds of cells. Typically, in multilayer networks, one access node provides one kind of a cell or cells, and thus a plurality of (e/g)NodeBs are required to provide such a network structure.

For fulfilling the need for improving the deployment and performance of communication systems, the concept of "plug-and-play" (e/g)NodeBs has been introduced. Typically, a network which is able to use "plug-and-play" (e/g)Node Bs, includes, in addition to Home (e/g)NodeBs (H(e/g)nodeBs), a home node B gateway, or HNB-GW (not shown in FIG. 1). A HNB Gateway (HNB-GW), which is typically installed within an operator's network may aggregate traffic from a large number of HNBs back to a core network.

In some embodiments, the system illustrated in FIG. 1 may be a system comprising one or more active-passive antenna (APA) system. Specifically, the access node 104 may comprise an APA system. An APA system may be defined as an antenna system which integrates (5G) active MIMO antenna array with a (4G or lower) passive antenna array (or a singular antenna). An active antenna array is defined generally as an antenna array into which one or more active electronics components (i.e., active circuitry) have been integrated. Specifically, an active antenna array may be defined, here and in the following, as an antenna array to which a radio unit (being a radio transmitter, receiver or transceiver or a part thereof comprising active as well as passive elements) has been integrated.

The APA system may specifically be an antenna system which integrates (5G) active massive MIMO antenna array with (4G or lower) passive antenna array (or a singular antenna). The term "massive MIMO antenna array" refers to a MIMO antenna array with a large number of individual antenna elements. In a massive MIMO (mMIMO) system, the number of antenna elements in a MIMO antenna array of an access node may be assumed to be larger than the number of terminal device served by that access node. For example, a massive MIMO antenna array may be defined, here and in the following, as a MIMO antenna array with at least 8, 16 or 32 antenna elements.

Some present APA solutions employ modular structures where the passive and/or active parts of the APA form separate but electrically (and physically) connected modules which may be independently removable and replaceable, even "in the field" (i.e., on site). However, as multiple electrical connections typically exist between the active and passive parts or modules of the APA, the process of replacing said modules of the APA is often complicated and time consuming as this requires, first, removing all of electrical connections between the active and passive antenna modules. For example, in some solutions, the passive antenna module is not be detachable as a single part, but must, before detaching, be split into multiple smaller parts.

The embodiments seek to provide modular APA systems and modules thereof where the active antenna module (equally called the active module) and the passive antenna module (equally called the passive module) are separate entities not connected electrically (i.e., via RF connectors) for facilitating their removal and replacement. The active antenna module is, in contrast to conventional APA solutions, not specifically designed for integration with the passive antenna module and may, as a consequence, be used also separately from the passive antenna module. The same applies, mutatis mutandis, for the passive antenna module which is formed as a singular module, as opposed to multiple individual modules as in some conventional APA solutions. By eliminating the need for RF connectors between the active and passive antenna modules, the overall APA system is rendered less complex and may be capable of improved performance (e.g., in terms of gain and/or passive intermodulation). Such an APA system according to embodiments should still, however, be compact (e.g., to minimize weight and wind load) and provide good performance. Moreover, said APA system according to embodiments should be preferably configured such that the APA system is able to operate in a satisfactory manner without its performance being significantly deteriorated due to any antenna blockage caused by the passive antenna module to the active antenna module and vice versa.

Figure 2A:
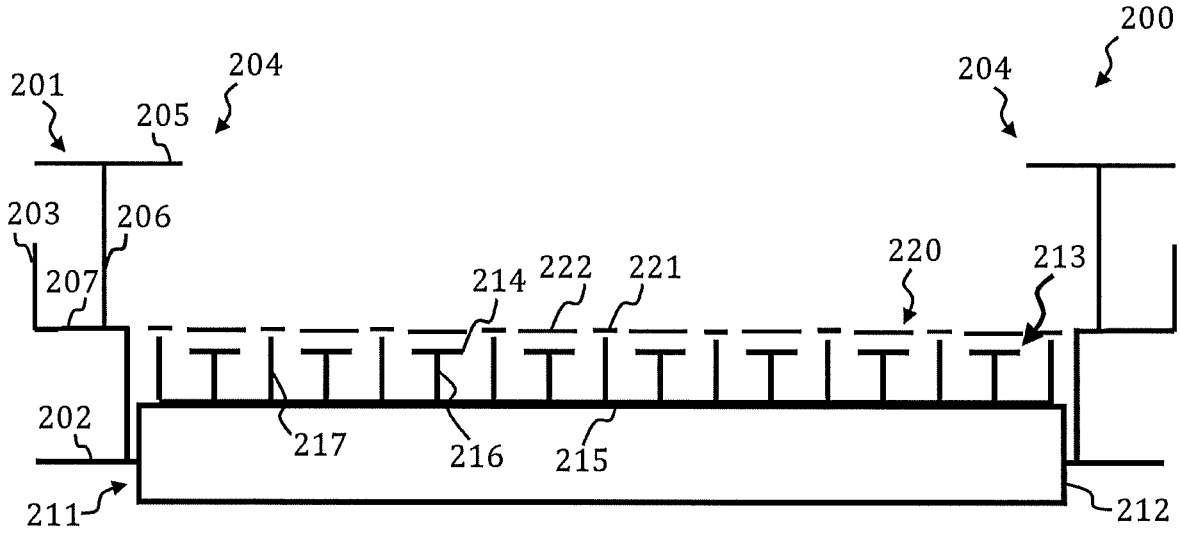
FIGS. 2A, 2B and 3 illustrate active-passive antenna systems according to embodiments.
Figure 2B:
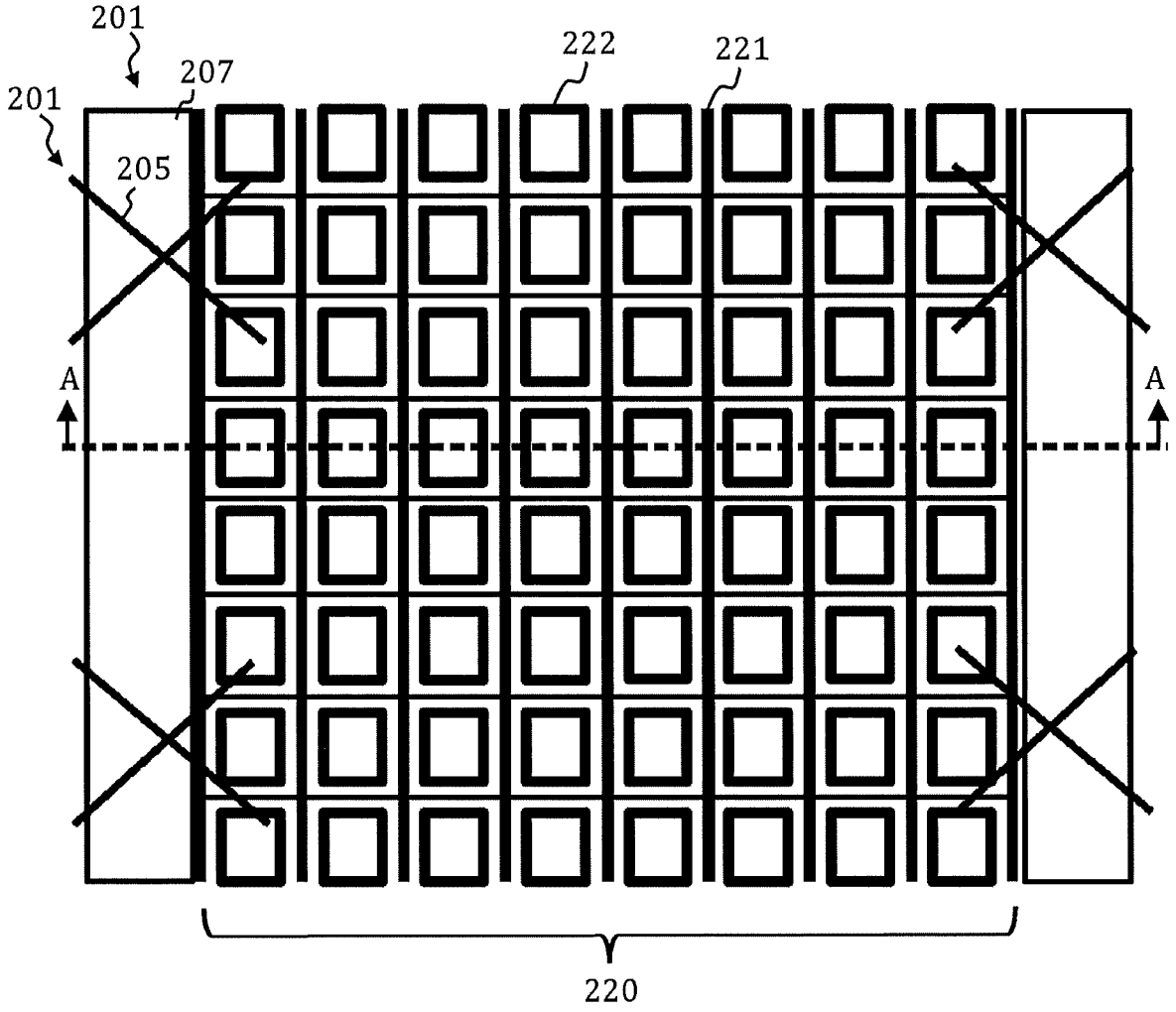

FIGS. 2A and 2B provides a schematic illustration of an APA system 200 according to embodiments with fully separatable and independently operatable passive and active antenna modules 201, 211. Specifically, FIG. 2A illustrates a simplified APA system 200 in a cross-sectional side view while FIG. 2B shows a view from above. FIG. 2A corresponds to a cross section 'A' illustrated in FIG. 2B. The APA system 200 may form a part of a terminal device such as one of terminal devices 100, 102 of FIG. 1 or of an access node such as an access node 104 of FIG. 1.

It should be noted that FIGS. 2A and 2B show a very simplified view where many of the elements of the APA system 200 (e.g., any power distribution elements, a radio unit and radomes) have been omitted. A more detailed view of an exemplary APA system is provided in FIG. 3 which are to be discussed later.

Referring to FIGS. 2A and 2B, the APA system 200 comprises a passive antenna module 201 and an active antenna module 211. The passive antenna module 201 comprises a first antenna array 204 comprising a plurality of first antenna elements (of which two and four first antenna elements 205 are shown in FIGS. 2A and 2B, respectively) and the active antenna module 211 comprises a second antenna array 213 comprising a plurality of second antenna elements 214. Said two first antenna elements 205 are specifically arranged on opposing sides of the active antenna module 211. The second antenna array 213 may be a (5G) active massive MIMO antenna array and the first antenna array 204 may be a (4G or lower) passive antenna array (or even just a singular antenna).

The passive antenna module 201 further comprises a first chassis 202 (or equally a first frame), and the active antenna module 211 further comprises a second chassis 212 (or equally a second frame). The first chassis 202 may, in practice, surround the active antenna module 211, fully or partly, such that an (elongated) opening or cavity is provided in the first chassis 202 for receiving the active antenna module 211. Said two first antenna elements 205 may be specifically arranged on opposing (elongated) sides of said opening or cavity. The first chassis 202 may be, at least in part, made of metal so as to implement a (planar) metallic ground plane 207. The first chassis 202 may be detachably attachable or mountable onto the second chassis 212 of the active antenna module 211. However, no (wired) electrical connection may be provided (or needs to be provided) between the passive and active antenna module 201, 211. In other words, the passive and active antenna module 201, 211 may be fully independent radio modules connected to each other (only) mechanically. The first chassis 202 and said mounting action is discussed, in more detail, in connection with FIG. 3.

In general, the first antenna array 204 may be adapted to operate at a first (operational) frequency band while the second antenna array 213 may be adapted to operate a second (operational) frequency band higher than the first (operational) frequency band. The first frequency band may be a radio frequency band, e.g., within the super high frequency (SHF) band and/or the ultra high frequency (UHF) band and the second frequency band may be a radio frequency band, e.g., within the extremely high frequency (EHF) band and/or any higher frequency band. In some embodiments, the center frequency of the second frequency band may be equal to or larger than the center frequency of the first frequency band times two, three or four. For example, the first antenna array 204 may be adapted to operate below 1 GHz (e.g., at 694-960 MHz frequency band), while the second antenna array 213 may be adapted to operate at 3.3-3.8 GHz frequency band or at 3.3-4.2 GHz frequency band or other frequency band lowest frequency of which is at least three times the highest frequency of the first operational frequency band of the first antenna array 204.

The first antenna array 204 may be specifically a one- or two-dimensional planar array with uniform antenna spacing. The first antenna array 204 is arranged, at least partially, adjacent to the second antenna array 213 of the active antenna module 211. In general, the first antenna elements 205 of the first antenna array 204 may be arranged adjacent to one (longitudinal) side of the active antenna module 211 or adjacent to two opposing (longitudinal) sides of the active antenna module 211 (longitudinal direction being the vertical or up/down direction in FIG. 2B). As shown in FIGS. 2A and 2B, the first antenna elements 205 extend partially over the active antenna module 211 (or equally over an opening or cavity provided in the passive antenna module 201 or over a metallic grid 221 within said opening or cavity and a two-dimensional array of metallic patches 222 arranged within said metallic grid). The plurality of first antenna elements 205 of the first antenna array 204 may be arranged, at least for the most part, over a (planar) metallic ground plane 207 of the passive antenna module 201 (being different from the ground plane 215 of the active antenna module 211).

The plurality of first antenna elements 205 of the first antenna array 204 may be any conventional resonant antenna elements used in antenna arrays such as patch or crossed-dipole antennas of any known design. The plurality of first antenna elements 205 may be dual-polarized antenna elements. Preferably, the first antenna element(s) 205 should be designed such that the antenna blockage caused by them to the second antenna array 213 is minimized. This may be achieved, in general, by minimizing the metallic or metallized (or in general electrically conductive) surface area of the first antenna element(s) 205. For example, a crossed-dipole-type or patch-type antenna design may be used for the first antenna elements 205. In an embodiment, the one or more first antenna elements 205 are crossed-dipole type antenna elements with one or more slots in each dipole arm for minimizing blockage caused to the second antenna array 213. The first antenna element(s) 205 may be, for example, microstrip antennas (without a ground plane), i.e., printed circuit board (PCB)-based printed antennas, or antennas formed of separate (thin) metal sheets. Said first antenna element(s) 205 may be specifically omnidirectional and/or dual-polarized antenna elements. The first antenna element (s) 205 may be made, at least partially, of a metal or an alloy.

The plurality of first antenna elements 205 may be separated from this first ground plane 207 by free space (i.e., air) or by a substrate (on which the plurality of first antenna elements 205 may be printed and other side of which may be metallized to form the first ground plane 207. The first antenna array 204 may be arranged, at least in some embodiments, substantially at a distance of $\lambda/4$ from the first chassis 202 acting as its ground plane (or specifically from a first ground plane 207 formed by the first chassis 202), where $\lambda$ is a first wavelength being a wavelength corresponding to a frequency (e.g., a center frequency) within a first operational frequency band of the first antenna array 204. The first ground plane 207 may serve as a primary ground plane for the first antenna array 204 (as it lies, at least for the most part, directly below the first antenna elements 205). The passive antenna module 201 comprises a ground plane layer 220.

Said ground plane layer 220 may be arranged within or over said opening or cavity in the passive antenna module 201. Said ground plane layer 220 may be fixed to the first chassis 202 of the passive antenna module 201. Said ground plane layer 220 may be configured such that it is capable of acting as a ground plane for the first antenna array 204 while allowing a (significant) part of the (higher frequency) electromagnetic waves radiated by the second antenna array 213 to pass through it. In other words, the ground plane layer 220 may serve as a secondary ground plane for the first antenna array 204 and be transparent or at least semitransparent at frequencies above a certain pre-defined frequency (being a frequency above the operational frequencies of the first antenna array 204) or at least at the second operational frequency band of the second antenna array 213 of the active antenna module 211. The ground plane layer 220 may be, at least in some embodiments, substantially aligned (vertically) with the first ground plane 207. In other embodiments, the ground plane layer 220 may be arranged to be at a lower level compared to the first ground plane 207. The first antenna array 204 may be arranged, at least in some embodiments, substantially at a distance of $\lambda/4$ from the ground plane layer 220 acting as its ground plane, where $\lambda$ is the first wavelength being a wavelength corresponding to a frequency (e.g., a center frequency) within the first operational frequency band of the first antenna array 204. Thanks to the ground plane layer 220, the passive antenna module 201 is fully operational even without the active antenna module 211 (i.e., the first antenna array 204 does not have to depend on using the ground plane of the active antenna module 211 as its ground plane).

Said ground plane layer 220 comprises, in the illustrated example, a metallic or metallized grid 221 and a two-dimensional array of metallic patches 222 arranged within the metallic grid 221. Each metallic patch of the two-dimensional array 222 may be located within a particular unit cell of the metallic grid 221. In general, a unit cell of a grid may be defined as the smallest repeating unit of the grid. In some alternative embodiments, a metallized grid (i.e., a grid made of a non-metallic material but having a metallized (outer) surface) may be employed instead of a metallic grid 221. The metallic or metallized grid 221 may be electrically connected to the first ground plane 207.

The metallic or metallized grid 221 (equally called a mesh) may be of any type of grid. The metallic or metallized grid 221 may be a regular grid or an irregular grid. For example, the metallic or metallized grid 221 may be a square grid, a rectangular grid, a rhombus grid, a triangular grid or a regular or irregular polygonal grid. The metallic or metallized grid 221 may have a first period along a first direction and a second period along a second direction orthogonal to the first direction.

The metallic or metallized grid 221 may have a period or multiple periods along different directions which are electrically small in view of the first antenna array 204 and its operating frequencies. The largest dimension of a unit cell (or the period or the largest period if multiple different periods are definable) of the metallic or metallized grid 221 may be defined such that the metallic or metallized grid 221 is capable of acting as a ground plane for the first antenna array 204. For example, the largest dimension of a unit cell (or the period or the largest period if multiple different periods are definable) of the metallic or metallized grid 221 may be, e.g., smaller than a second wavelength divided by five, by six, by seven, by eight, by nine, by ten, by eleven or by twelve, where said second wavelength is a (free-space) wavelength corresponding to a frequency (e.g., a center frequency) within a first operational frequency band of the first antenna array 204. Additionally or alternatively, the largest dimension of a unit cell (or the period or the largest period if multiple different periods are definable) of the metallic or metallized grid 221 may be, e.g., larger than a third wavelength divided by five, four, by three or by two, where said third wavelength is a (free-space) wavelength corresponding to a frequency (e.g., a center frequency) within a second operational frequency band of the second antenna array 213. The selected period(s) of the metallic or metallized grid 221 may correspond to a compromise between effective ground plane behavior at the first operational frequency band and effective (semi)transparent behavior at the second operational frequency band taking possibly also into account the dimensions of the second antenna elements 214 of the second antenna array 213 (assuming that the second antenna array 213 has the same period as the metallic or metallized grid 221).

The metallic patches of the two-dimensional array 222 may located within the (unit) cells of the metallic or metallized grid 221 (each or most of the unit cells of the metallic or metallize having within them a metallic patch). The metallic patches may be shaped so that they substantially fill the unit cell of the metallic or metallized grid 221 or at least fill most of the unit cell of the metallic or metallized grid 221. The metallic patches may be, for example, square patches, rectangular patches, circular patches, elliptical patches or any patches having a shape of a regular or irregular polygon.

The ground plane layer 220 (or at least the two-dimensional array of metallic patches 222 thereof) may be implemented, for example, as at least one printed circuit board (not shown in FIGS. 2A and 2B).

As long as the ground plane layer 220 is arranged to be sufficiently near the second antenna array 213 of the active antenna module 211 when the passive and active antenna modules 201, 211 are connected (i.e., when the first chassis 202 of the passive antenna module 201 is mounted onto the active antenna module 211), the propagation characteristics of the active antenna array 213 (e.g., S11, gain and radiation pattern) remain relatively unchanged and thus the active antenna module 211 is still functional. The ground plane layer 220 may be arranged, e.g., so that it is located at least within an (electrically) small distance from the second antenna array 213 of the active antenna module 211 when the passive and active antenna modules 201, 211 are connected. Such an electrically small distance may be, for example, at least equal to or smaller than $\lambda/4$, $\lambda/5$, $\lambda/6$, $\lambda/7$, $\lambda/8$, $\lambda/9$, $\lambda/10$, $\lambda/12$ or $\lambda/15$ (depending on the particular desired performance), where $\lambda$ is a (free-space) wavelength corresponding to a frequency (e.g., a center frequency) within the second operational frequency band of the second antenna array 213.

In some embodiments, the two-dimensional array of metallic patches 222 may be omitted. In such embodiments, the ground plane layer 220 may comprise only the metallic or metallized grid 221 (implemented, e.g., as at least one PCB or as a separate grid made of metal or made of a non-metallic material having a metallized surface). It is well known that even a simple metallic grid is capable of approximating a ground plane.

The plurality of first antenna elements 205 may be fed by feeding means or elements 206 which may form a part of first power distribution means of the passive antenna module 201 for enabling beamforming for the first antenna array 204. Other elements of the first power distribution means may comprise one or more phase shifters forming a first phase shifter network located, e.g., inside the element 202. Said feeding elements 206 may act also as supporting elements for the plurality of first antenna elements 205 (e.g., in microstrip line feeding, the PCB(s) may provide support) or alternatively they may be integrated into separate supporting elements.

The feeding may be arranged, e.g., with coaxial cables (using baluns) or with microstrip lines. In some embodiments, the passive antenna module 201 may comprise a balun integrated into the power distribution means or forming a part thereof. A balun is an electrical device which converts balanced signals and unbalanced signals and vice versa. Specifically, a balun may be used here for converting an unbalanced signal of a coaxial cable to a balanced signal to be fed to the first antenna element 205 (e.g., a crossed-dipole-type antenna) in transmission and providing opposite operation in reception. The balun may be, for example, a sleeve balun configured to operate at the first frequency band (or at least configured to operate optimally at a frequency within the first frequency band).

The second antenna array 213 may be specifically a one- or two-dimensional planar array with uniform antenna spacing. The plurality of second antenna elements 214 of the second antenna array 213 may be arranged over the (planar) ground plane 215. The plurality of second antenna elements 214 may be separated from the ground plane 215 by free space (i.e., air) or by a substrate (on which the plurality of second antenna elements 214 may be printed and other side of which may be metallized to form the ground plane 215). The plurality of second antenna elements 214 may be fed by feeding elements 216 which may form a part of second power distribution means of the active antenna module 211 (other elements being, e.g., inside element 214) for enabling beamforming for the second antenna array 213. Each feeding element 216 may correspond, for example, to a one or more coaxial cables or other transmission lines for feeding a corresponding second antenna element 214 at one or more feed points (with the outer conductor of the coaxial cable being connected to the ground 215) or one or more pairs of feed points. The ground plane 215 may be mounted on the second chassis 212 of the active antenna module 211.

All of the plurality of second antenna elements 214 of the second antenna array 213 have the same geometry and dimensions. Said plurality of second antenna elements 214 may be any conventional resonant antenna elements used in (5G) antenna arrays such as patch or crossed-dipole antennas of any known design. The plurality of second antenna elements 204 may be dual-polarized antenna elements. Said plurality of second antenna elements 214 may be microstrip antennas, i.e., printed circuit board (PCB)-based printed antennas, or antennas formed of separate (thin) metal sheets. Said plurality of second antenna elements 214 may be specifically omnidirectional and/or dual-polarized antenna elements. The plurality of second antenna elements 214 may be made, at least partially, of a metal or an alloy.

The plurality of second antenna elements 214 may be assumed to be considerably smaller (or specifically electrically smaller) than any operational wavelength of the first antenna array 204 so that the plurality of second antenna elements 214 are capable of interacting only weakly with any electromagnetic waves transmitted by the first antenna array 204 or receivable via the first antenna array 204. However, some antenna blockage may still be caused by the first antenna array 204 to the second antenna array 213, especially when large beam scanning angles are employed.

While not shown in FIG. 2A, the active antenna module 211 may comprise a radio unit operatively coupled to the second antenna array 213 for radio reception and/or transmission via the second antenna array 213 and/or other at least partially active circuitry. Said radio unit may be a radio receiver, transmitter or transceiver. As mentioned briefly above, the active antenna module 211 also comprises second power distribution means for distributing power to and from the plurality of second antenna elements 214 of the second antenna array 213. The second power distribution means may provide one or more input/output ports.

Finally, it should be noted that, vertical metallic walls 203, 217 extending orthogonally from the first and second ground planes 207, 217 are provided in the illustrated embodiment in order to better isolate the first and second antenna arrays 204, 213 from each other. The metallic walls 203, 217 may be provided along one direction or along two orthogonal directions (thus forming a grid of walls). The metallic walls 217 of the active antenna module 211 may substantially align with the metallic or metallized grid 221 of the passive antenna module 201 when the passive and active antenna modules 201, 211 are connected (as shown in FIG. 2A). In other embodiments, elements 203, 217 may be omitted.

Figure 3:
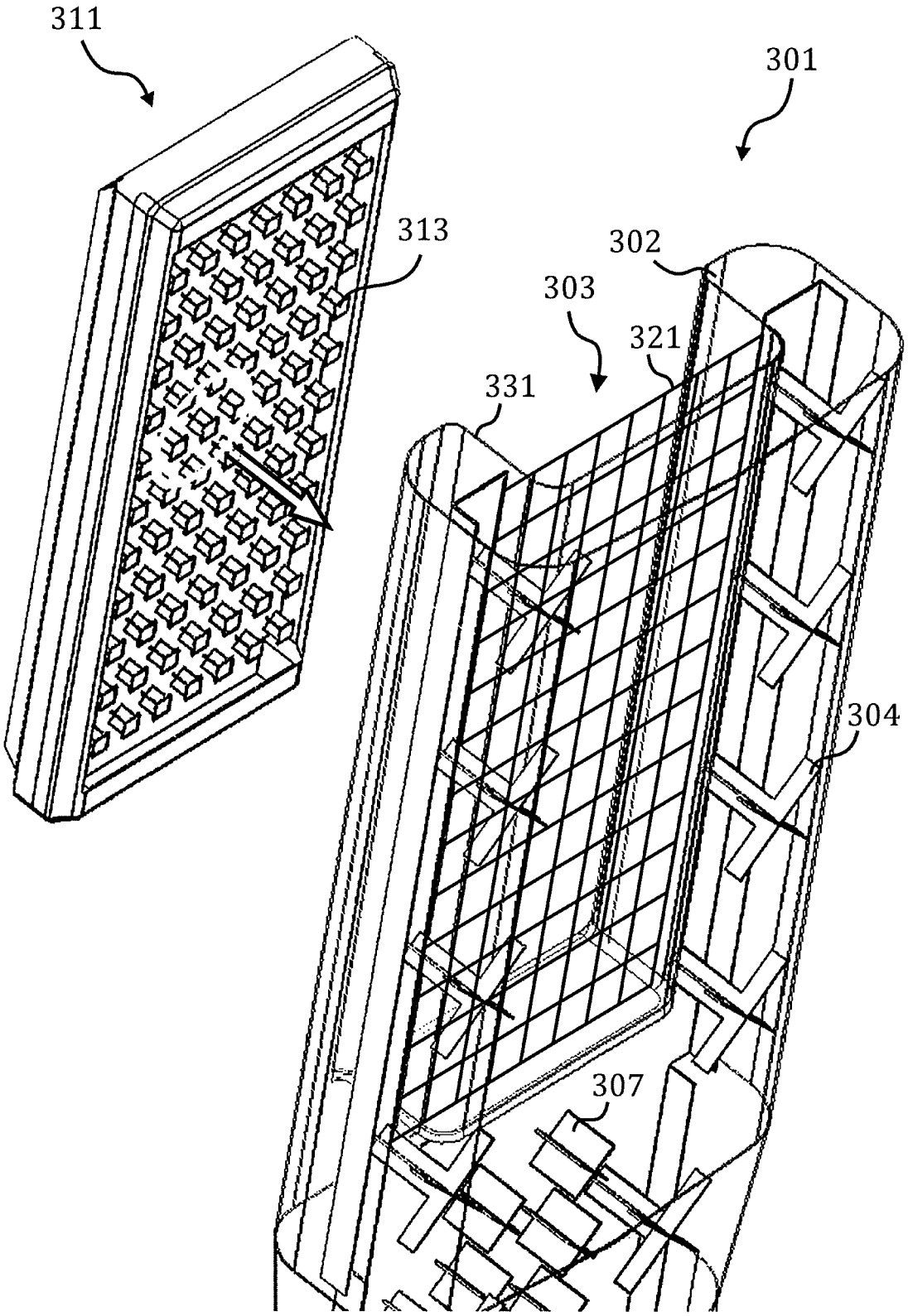

FIG. 3 illustrates, in a more detailed view compared to FIGS. 2A and 2B, an APA system 300 comprising passive and active antenna modules 301, 311 according to embodiments. Specifically, FIG. 3 illustrates the APA system 300 according to an exemplary embodiment in a perspective view when the passive and active antenna modules 301, 311 are not yet attached to each other and in another perspective view when the passive and active antenna modules 301, 311 are attached to each other. In general, the APA system 300 may correspond to the APA system 200 of FIGS. 2A and 2B.

Referring to FIGS. 3A and 3B, the passive antenna module 301 comprises a first chassis (or frame) 302 which is suitable for detachably mounting (or detachably attaching) onto an active antenna module 311 of the APA system 300. The first chassis 302 may, at least for the most part, be made of a metal or an alloy. For enabling this, the first chassis 302 comprises a cavity 303 adapted to extend over the active antenna module 311 when the first chassis 302 is mounted onto the active antenna module 311 for minimizing antenna blockage caused by the passive antenna module 301 (predominantly by the first chassis 302 thereof). The cavity 303 may specifically penetrate through the first chassis 302 in a direction orthogonal to a plane of the first chassis 302 (or equally orthogonal to the plane of the first antenna array 304). The cavity may be formed onto a lateral side of the first chassis 302. The arrow in FIG. 3A indicates the mounting direction. The cavity 303 may extend specifically at least partially over a second antenna array of the active antenna module 311 when the first chassis 302 is mounted onto the active antenna module 311. Once mounted, the first chassis 302 of the passive antenna module 301 is adapted to substantially surround the active antenna module 311 (i.e., surround it from three sides with one lateral side being left open). In other words, the active antenna module 311 is embedded into the first chassis 302 of the passive antenna module 301.

In other embodiments, an opening (or a hole) may be provided in the first chassis 302, instead of a cavity. The difference between the opening and a cavity is that the opening is surrounded from all sides by the first chassis while the cavity may be open at one side (as shown in FIG. 3). Said opening may extend over the active antenna module 311 when the first chassis 302 is mounted onto the active antenna module 311 for minimizing antenna blockage caused by the passive antenna module 301 (predominantly by the first chassis 302 thereof). The opening 303 may extend specifically at least partially over a second antenna array of the active antenna module 311 when the first chassis 302 is mounted onto the active antenna module 311. The opening 303 may be, for example, a rectangular opening. Once mounted, the first chassis 302 of the passive antenna module 301 is adapted to surround the active antenna module 311. In other words, the active antenna module 311 is embedded into the first chassis 302 of the passive antenna module 301.

As shown in FIG. 3, both the first chassis 302 and the opening or cavity 303 may have a shape which is elongated along the same direction. Further, the one or more first antenna elements may be arranged specifically adjacent to one or more longitudinal sides of the opening or cavity 302 (i.e., not necessarily adjacent to a lateral side of the opening or cavity 302).

The ground plane layer may be fitted into the opening or cavity 303. In this particular example, the ground plane layer comprises only a metallic or metallized grid 321.

The passive antenna module 301 further comprises a first antenna array 304 comprising a plurality of first antenna elements (here, specifically eight) arranged on two opposing sides of the cavity 303. The first antenna array 304 (and associated feeding structure or element) may be mounted directly onto the first chassis 302 in this embodiment, as discussed above. The plurality of first antenna elements may be arranged, at least partially, adjacent to the cavity 303. The plurality of first antenna elements may partially overlap or extend over the cavity 303 (though they may predominantly lie over the first chassis 302 as shown in FIG. 3). The first antenna array 304 may be arranged substantially at a distance of $\lambda/4$ from the first chassis 302 acting as its ground plane and/or from the ground plane layer (comprising here the metallic or metallized grid 321), where $\lambda$ is a first wavelength being a wavelength corresponding to a frequency (e.g., a center frequency) within the first frequency band of the first antenna array 304.

In some embodiments, the passive antenna module 301 may comprise, in addition to the first antenna array 304, also one or more other passive antenna arrays 307 arranged over the first chassis 302 and adjacent to the cavity 303 (i.e., not above it) and to the first antenna array 304. Specifically, said one or more other passive antenna arrays 307 may be arranged adjacent to the cavity 303 in a longitudinal direction of the first chassis 302, as opposed to being adjacent to the cavity 303 in a lateral direction of the first chassis 302 like the first antenna array 304.

The passive antenna module 301 comprises also a first radome 331 for protecting the passive antenna module 301 as well as the active antenna module 311 when it is attached to the passive antenna module 301. The first radome 331 may be made, e.g., of polycarbonate.

It should be noted that while FIG. 3 shows the metallic or metallized grid 321 being arranged outside the first radome 331, in other implementations, said metallic or metallized grid 321 (or the ground plane layer in general) may be arranged to be within the first radome 331 of the passive antenna module 301.

Figure 4:
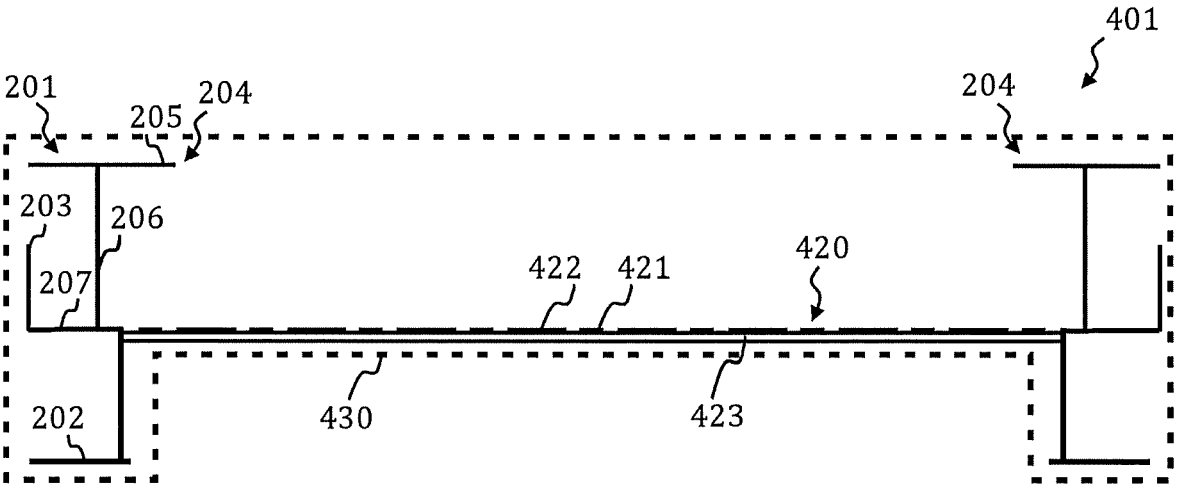
FIG. 4 illustrates a passive antenna module for an active-passive antenna system according to embodiments.

FIG. 4 provides a schematic illustration of a passive antenna module 401 of an APA system (detached from the active antenna module). Specifically, FIG. 4 illustrates passive antenna module 401 in a side view. It should be noted that FIG. 4 shows a very simplified view where many of the elements of the passive antenna module 401 (e.g., any power distribution elements) have been omitted. The passive antenna module 401 may form a part of a terminal device such as one of terminal devices 100, 102 of FIG. 1 or of an access node such as an access node 104 of FIG. 1.

The passive antenna module 401 may correspond, to a large extent, to the passive antenna module 201 of FIGS. 2A and 2B as indicated by the shared reference signs. Any of the features discussed in connection with FIGS. 2A and 2B and/or FIG. 3 may apply, mutatis mutandis, also here. In the following, only the differences between the passive antenna modules of FIGS. 2 and 4 are discussed.

As in previous embodiments, the passive antenna module 401 comprises a ground plane layer 420 which here comprises a metallic or metallized grid 421 and a two-dimensional array of metallic patches 422. Here, the ground plane layer 420 is implemented as a printed circuit board 423. The printed circuit board 423 is arranged within (in some alternative embodiments, over) the opening or cavity of the first chassis 202 and fixed to the first chassis 202. The metallic or metallized grid 421 and the two-dimensional array of metallic patches 422 correspond, in this case, to a metallized pattern on a surface of said at least one printed circuit board 423 with an opposing surface to said surface being bare (i.e., not metallized). The metallization of the printed circuit board 423 may be electrically connected (e.g., via soldering) to the ground plane 207 of the first chassis 202. While here the metallic or metallized grid 421 and the two-dimensional array of metallic patches 422 are printed on an upper surface of the printed circuit board, in other embodiments, they may be printed on the lower surface of the printed circuit board 423 or on two opposing surfaces of said at least one printed circuit board 423, respectively. Any conventional PCB material may be used here. The printed circuit board 423 may be thin (e.g., less than 1 mm) and/or of low permittivity (e.g., relative permittivity less than 5 or less than 3) so that any detrimental effect of the dielectric of the printed circuit board on the propagation properties is minimized.

Moreover, FIG. 4 illustrates, with a dashed line, a radome 430 surrounding the passive antenna module 401. The radome 430 may be made, e.g., of polycarbonate. It should be noted that no specific connection exists between the radome 430 and the PCB implementation of the ground plane layer 420, that is, a particular embodiment may implement one or both of said features.

While the APA systems as discussed in connection with FIGS. 2, 3A, 3B and 4 may work adequately in many scenarios, they come with multiple disadvantages. Due to the passive antenna array extending partially over the active antenna array (as shown, e.g., in FIGS. 2A and 2B), the scanning capabilities of the active antenna array may be limited due to antenna blockage. In other words, if a large scanning angle (relative to broadside direction) is used, the beam is at least partially obstructed by the passive antenna module causing a deterioration of the performance of the active antenna array. Due to practical considerations relating to, e.g., mechanical design, it may not always be possible to adapt the active antenna module such that its ground plane aligns with the ground plane provided the chassis of the passive antenna module (as shown in FIGS. 2A and 2B), that is, the active antenna array may need to be arranged at a lower level relative to the passive antenna array compared to the APA system of FIGS. 2A and 2B. This further exacerbates the aforementioned beam scanning problem leading to severely limited beam scanning capability. These problems could be overcome if the electromagnetic fields radiated by the active antenna module could be transferred or guided farther from the active antenna array and subsequently re-radiated.

Figure 5:
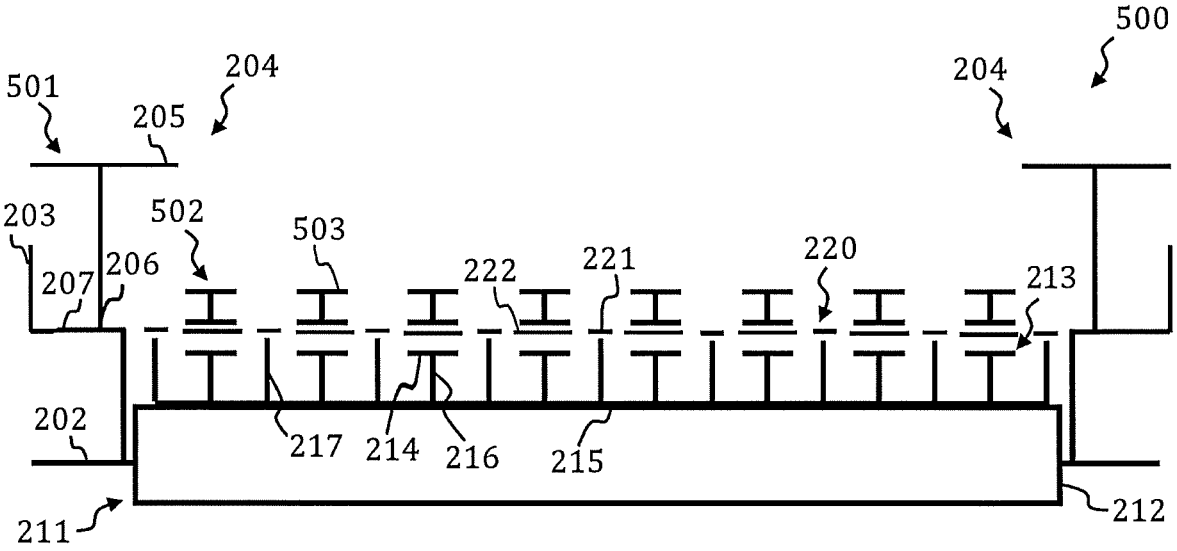
FIGS. 5 and 6 illustrate, respectively, active-passive antenna systems employing electromagnetic coupling and waveguiding elements according to embodiments.

FIG. 5 provides a schematic illustration of an APA system 500 according to embodiments. Specifically, FIG. 5 illustrates an APA system 500 (comprising a passive antenna module 501 and an active antenna module 511) in a side view. It should be noted that FIG. 5 shows a very simplified view where many of the elements of the passive antenna module 501 (e.g., any power distribution elements, a radio unit and radomes) have been omitted. The APA system 500 may form a part of a terminal device such as one of terminal devices 100, 102 of FIG. 1 or of an access node such as an access node 104 of FIG. 1.

The APA system 500 may correspond, to a large extent, to the APA system 200 of FIGS. 2A and 2B as indicated by the shared reference signs. The active antenna module 211 of FIG. 5 may correspond fully to the active antenna module 211 of FIGS. 2A and 2B. Any of the features discussed in connection with FIGS. 2A and 2B and/or FIG. 3 and/or FIG. 4 may apply, mutatis mutandis, also here. In the following, only the differences between the passive antenna modules 201, 501 of FIGS. 2 and 5 are discussed.

Referring to FIG. 5, the passive antenna module 501 corresponds to the passive antenna module 201 of FIGS. 2A and 2B with the addition of an array (or a set) 502 of electromagnetic coupling elements 503 arranged over the ground plane layer 220 (but separated from it by a certain distance) for coupling electromagnetic radiation received from the active antenna module to free space when the first chassis 202 is mounted onto the active antenna module. In other words, a coupling structure (e.g., a dipole or a loop) of the electromagnetic coupling elements 503 captures the electromagnetic fields radiated by the second antenna array 213, and these captured electromagnetic fields are, then, re-radiated by a radiating structure (e.g., a dipole, a patch or a loop) of the electromagnetic coupling elements 503. The electromagnetic coupling elements 503 may be configured to be excited at least at the second operational frequency band of the second antenna array 213 of the active antenna module 211 (or at least at some frequency or frequencies therein). Each of the electromagnetic coupling elements 503 may comprise one or more resonant elements having a resonance frequency within said second operational frequency band of the second antenna array 213.

The array 502 of electromagnetic coupling elements 503 may be substantially aligned with openings in the metallic or metallized grid 221. Additionally or alternatively, the array 502 of electromagnetic coupling elements 503 may be substantially aligned with the second antenna array 213 of the plurality of second antenna elements 214 (when the passive and active antenna modules 201, 211 are connected). The number of the electromagnetic coupling elements 503 may be equal to or lower than the number of the plurality of second antenna elements 214 in the second antenna array 213 (the former case being illustrated in FIG. 5).

In the illustrated example of FIG. 5, the electromagnetic coupling elements 503 are based on capacitive coupling. The illustrated electromagnetic coupling elements 503 may correspond more specifically to a structure where two horizontal dipoles (being parallel with the plurality of second antenna elements 214 and arranged at different distances from them) are connected with at least one vertical (metallic or metallized) section. Alternatively, the illustrated electromagnetic coupling elements 503 may correspond to two horizontal dual-polarized dipoles (being parallel with the plurality of second antenna elements 214 and arranged at different heights) which are connected with at least one vertical (metallic or metallized) sections, as will be discussed below in connection with FIG. 7.

The plurality of electromagnetic coupling elements 503 may, in general, comprise one or more capacitive coupling elements and/or one or more inductive coupling elements. A capacitive coupling element may, for example, comprise one or more (connected) dipoles arranged substantially parallel to the plurality of second antenna elements 214. An inductive coupling element may comprise, for example, one or more (connected) loops arranged along a plane substantially parallel to a plane of the plurality of second antenna elements 214.

The distance between the array 502 of electromagnetic coupling elements 503 and the ground plane layer 220 may be (electrically) small. Such an electrically small distance may be at least equal to or smaller than $\lambda/4$, $\lambda/5$, $\lambda/6$, $\lambda/7$, $\lambda/8$, $\lambda/9$, $\lambda/10$, $\lambda/12$ or $\lambda/15$, where $\lambda$ is a (free-space) wavelength corresponding to a frequency (e.g., a center frequency) within the second operational frequency band of the second antenna array 213 of the active antenna module 211. The array 502 of electromagnetic coupling elements 503 may lie in the near field or the non-radiating near field of the second antenna array 213 at the second operational frequency band of the second antenna array 213. The array 502 of the plurality of electromagnetic coupling elements 503 may be separated from the ground plane layer 220 by a spacer material layer such a dielectric layer (not shown in FIG. 5).

The array 502 of the plurality of electromagnetic coupling elements 503 may be separated from the ground plane layer 220 by a spacer material layer such a dielectric layer (not shown in FIG. 5).

Figure 6:
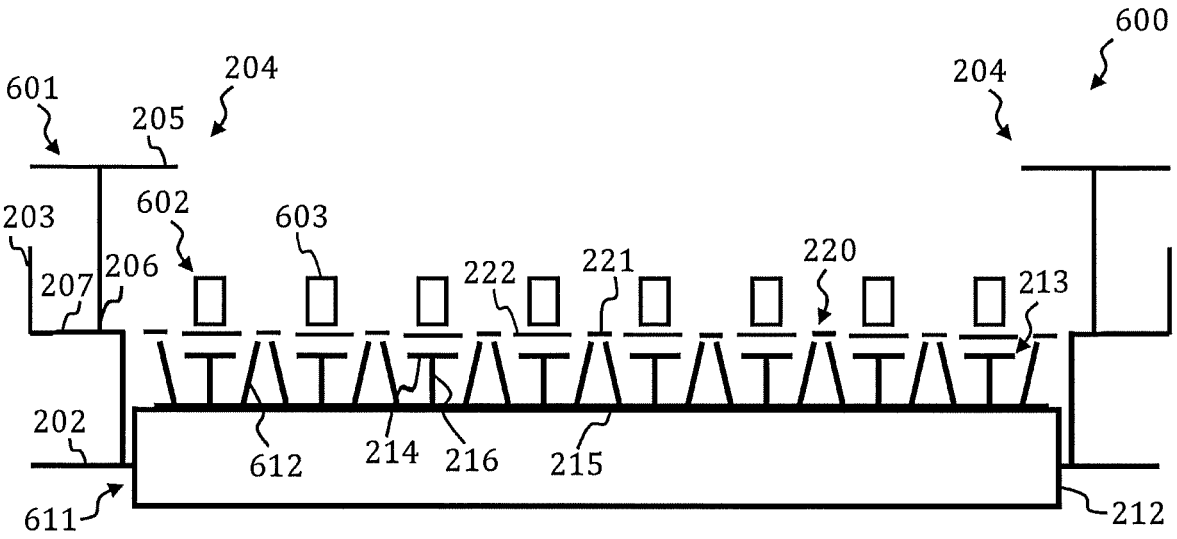

FIG. 6 provides a schematic illustration of an APA system 600 according to embodiments. Specifically, FIG. 6 illustrates an APA system 600 (comprising a passive antenna module 601 and an active antenna module 611) in a side view. It should be noted that FIG. 6 shows a very simplified view where many of the elements of the passive antenna module 601 (e.g., any power distribution elements, a radio unit and radomes) have been omitted. The APA system 600 may form a part of a terminal device such as one of terminal devices 100, 102 of FIG. 1 or of an access node such as an access node 104 of FIG. 1.

The APA system 600 may correspond, to a large extent, to the APA system 200 of FIGS. 2A and 2B as indicated by the shared reference signs. Any of the features discussed in connection with FIGS. 2A and 2B and/or FIG. 3 and/or FIG. 4 may apply, mutatis mutandis, also here. In the following, only the differences between the APA systems 200, 600 of FIGS. 2 and 6 are discussed.

Referring to FIG. 6, the passive antenna module 601 corresponds to the passive antenna module 201 of FIGS. 2A and 2B with the addition of an array (or a set) 602 of electromagnetic waveguiding elements 603 (or equally an array 602 of electromagnetic waveguiding elements 603) arranged over the ground plane layer 220 (but separated from it by a certain distance) for guiding electromagnetic radiation received from the active antenna module to free space when the first chassis 202 is mounted onto the active antenna module. In other words, one end of the electromagnetic waveguiding elements 603 (e.g., one end of a waveguide) captures the electromagnetic fields radiated by the second antenna array 213, these captured electromagnetic fields propagate along the electromagnetic waveguiding elements 603 and are, then, re-radiated at the other end of the electromagnetic waveguiding elements 603. The electromagnetic waveguiding elements 603 may be configured to support electromagnetic waves at least at the second operational frequency band of the second antenna array 213 of the active antenna module 611 (or at least at some frequencies therein).

As mentioned above, the electromagnetic waveguiding elements 603 may be waveguides. For example, the electromagnetic waveguiding elements 603 may be hollow metallic (or metallized) waveguides or dielectric waveguides. The dielectric waveguides may be dielectric waveguides with or without metallic or metallized walls. The electromagnetic waveguiding elements 603 may be oriented, for example, substantially orthogonally to a plane of the second antenna array 213 for guiding the electromagnetic directly away from the second antenna array 213 (as shown in FIG. 6). The number of the electromagnetic waveguiding elements 603 may be equal to or lower than the number of the plurality of second antenna elements 214 in the second antenna array 213 (the former case being illustrated in FIG. 6).

The distance between the array 602 of electromagnetic waveguiding elements 603 and the ground plane layer 220 may be (electrically) small. Said distance may be at least equal to or smaller than $\lambda/4$, $\lambda/5$, $\lambda/6$, $\lambda/7$, $\lambda/8$, $\lambda/9$, $\lambda/10$, $\lambda/12$ or $\lambda/15$, where $\lambda$ is a (free-space) wavelength corresponding to a frequency (e.g., a center frequency) within the second operational frequency band of the second antenna array 213 of the active antenna module 511. In some embodiments, the array 602 of electromagnetic waveguiding elements 603 may even be in contact with the ground plane layer 220.

The distance between the ground plane layer 220 and the second antenna array 213 may also be (electrically) small, similar to as discussed in connection with previous embodiments. The array 602 of electromagnetic waveguiding elements 603 may lie at least in the near field of the second antenna array 213 at the second operational frequency band of the second antenna array 213.

The array 602 of the plurality of electromagnetic waveguiding elements 603 may be separated from the ground plane layer 220 by a spacer material layer such a dielectric layer (not shown in FIG. 6).

The active antenna module 611 shown in FIG. 6 differs from the active antenna module 211 of FIGS. 2A and 2B in that, instead metallic walls which are orthogonal to the ground plane 215 of the second antenna array 213, the active antenna module 611 comprises tilted (or slanted) metallic walls 612 projecting from the ground plane 215 at an angle (i.e., a non-90° angle). Said tilted metallic walls 612 are specifically tilted away from the second antenna elements 214 so as to form (with the ground plane 215) cup-like shapes (or equally horn antenna-like shapes) around the plurality of second antenna elements 214 and their feeding elements 216. In other words, a set of tilted metallic walls 612 formed around a particular second antenna element 214 may form the shape of an upside-down right frustum (e.g., with circular, square or regular polygonal bases) or have a shape formed by connecting a bottom base having a first shape (e.g., a circle) and a (larger) top base (substantially aligned with and parallel to the bottom base) having a second shape (e.g., square). These types of shape serve to more efficiently guide the electromagnetic fields radiated by the second antenna array 213 towards the desired direction (i.e., "up" in FIG. 6). In other embodiments, the metallic walls may be configured to project orthogonally from the ground plane 215, as in previous embodiments.

Figure 7A:
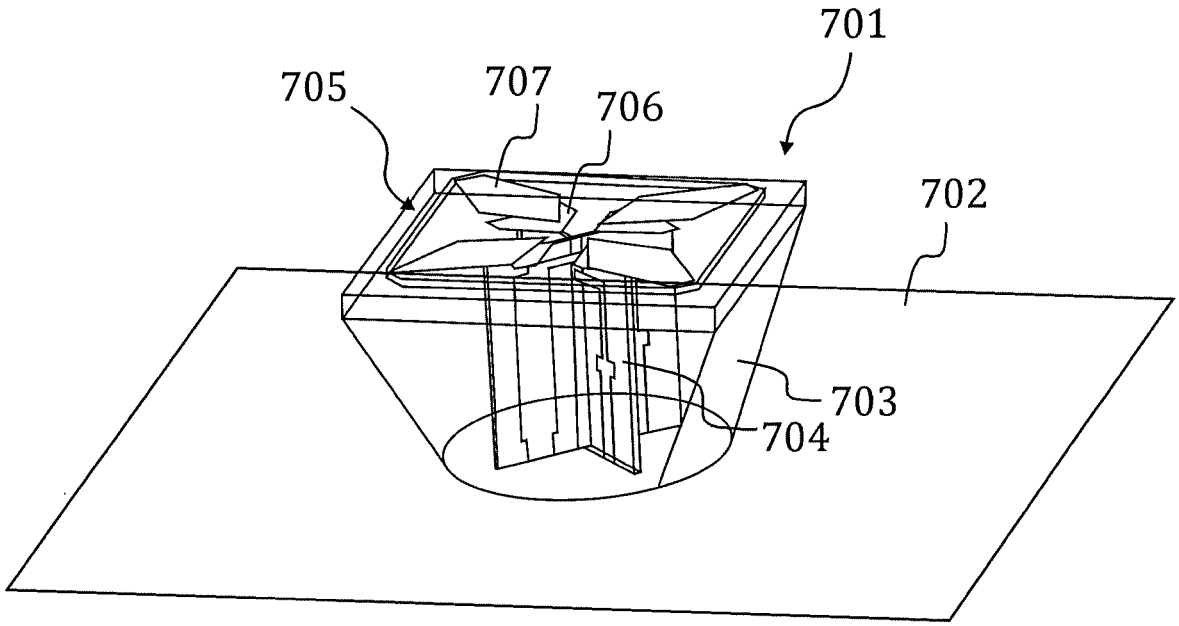
FIGS. 7A, 7B and 7C illustrate, respectively, an example of a unit cell of a second antenna array of an active antenna module, an example of a unit cell of a ground plane layer and capacitive coupling element of a passive antenna module and two unit cells arranged on top of each other.
Figure 7B:
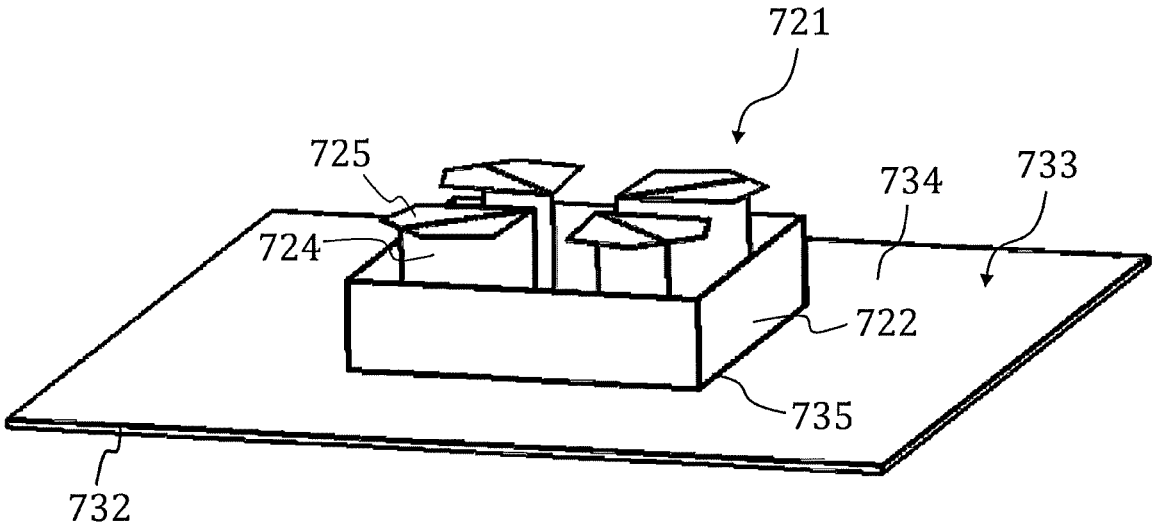
Figure 7C:
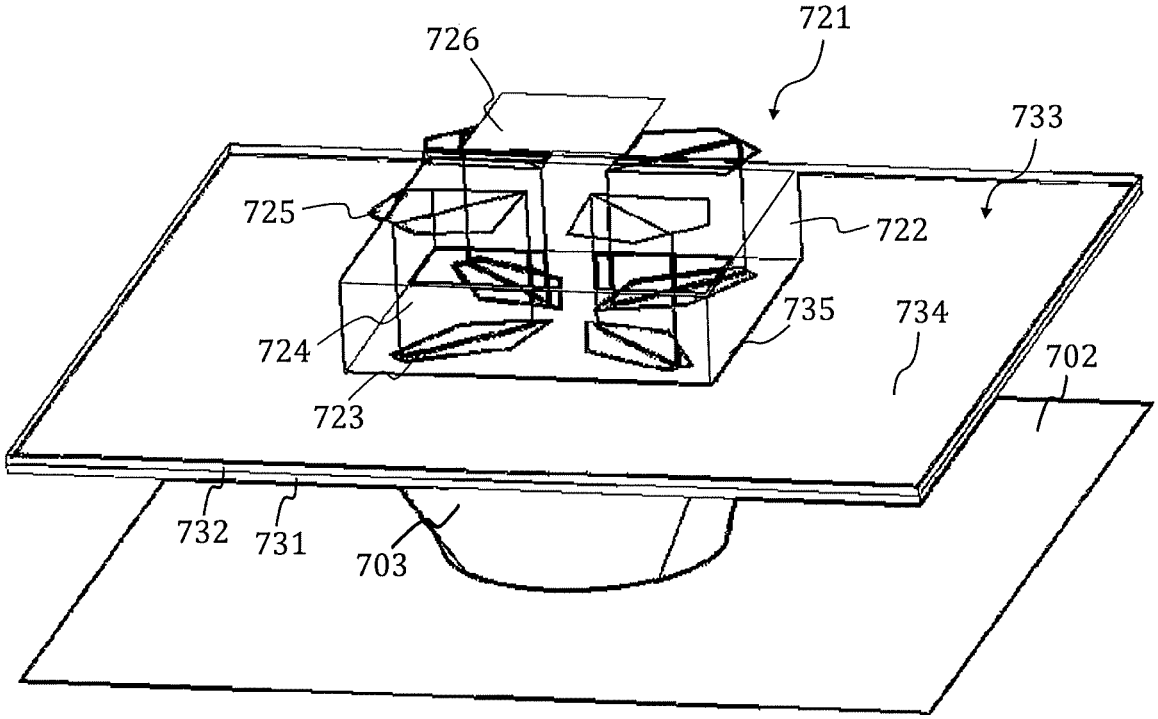

FIGS. 7A, 7B and 7C illustrate a practical non-limiting example of a capacitive coupling element of a passive antenna module arranged over a second antenna element 705 of a second antenna array of an active antenna module according to embodiments. Specifically, FIG. 7A illustrates a unit cell structure 701 of an active antenna module, FIG. 7B illustrates a capacitive coupling element 721 of a passive antenna module and FIG. 7C illustrates a combination of said a unit cell structure 701 and said capacitive coupling element 721. In FIG. 7C, some of the elements related to the capacitive coupling element 721 have been rendered transparent.

It should be noted that while FIGS. 7A, 7B and 7C show rather large empty spaces surrounding the unit cell structure 701, in a practical scenario, said elements 701, 721 may be arranged right next to each other, as shown, e.g., in FIGS. 2A and 2B.

Referring to FIG. 7A, the unit cell structure 701 of the active antenna module comprises a second antenna element 705, a feeding element 704 for the second antenna element 705 and a set of metallic walls 703 projecting from a ground plane 702 of the second antenna element 705 and surrounding the feeding element 704 and the second antenna element 705. The second antenna element 705 is a dual-polarized crossed-dipole dipole antenna comprising a primary crossed-dipole antenna element 706 fed by the feeding element 704 and a parasitic crossed dipole antenna element 707 arranged over the primary crossed-dipole antenna element 706 (separated from it by a certain distance). The primary and parasitic crossed dipoles 706, 707 may be printed on different sides of a printed circuit board. The feeding element 704 is implemented here using microstrip lines. The set of tilted metallic walls 703 formed around the feeding element 704 and the second antenna element 705 have a shape formed by connecting a bottom base having a circular shape and a top base aligned with and parallel to the bottom base having a square shape (with a narrow straight or non-tilted section at the distal end).

Referring to FIG. 7B (and FIG. 7C), the capacitive coupling element 721 of the passive antenna module comprises a crossed dipole-type capacitive element 721 and metallic walls 722 surrounding said crossed dipole-type capacitive element 721. The crossed dipole-type capacitive element 721 comprises a bottom crossed dipole element 723, a top crossed dipole element 725 and a section 724 connecting said bottom and top crossed dipole elements. Each of the bottom crossed dipole element 723 and the top crossed dipole element 725 comprises two dipoles crossing each other (with each dipole having two distinct opposing & parallel dipole arms) and thus forming an 'x' shape (as is characteristic for a crossed dipole). The crossed dipole-type capacitive element 721 may be made of a metal or an alloy. The metallic walls 722 projecting orthogonally from the ground plane layer 733 are used here for shaping of the electromagnetic field re-radiated by the crossed dipole-type capacitive element 721 (i.e., shaping of the antenna pattern produced by the second antenna element 705). In other words, the metallic walls 722 may serve a similar function to the walls 703.

The layer 732 may correspond to a radome of the passive antenna module (made of, e.g., polycarbonate).

The upper surface of the layer 732 may be metallized or a separate metallic sheet may be provided to form the ground plane layer 733. The ground plane layer 733 comprises a (continuous) metallic or metallized layer or surface 734 having an opening (or a hole) 735. The opening 735 coincides with the metallic walls 722 surrounding the capacitive coupling element 721, that is, the lower opening of the metallic walls 722 for facing the active antenna module corresponds to the opening 735 in the ground plane layer 733. As mentioned above, in a practical scenario, the capacitive coupling elements 721 may be arranged right next to each other (as shown, e.g., in FIG. 5) and thus the ground plane layer 733 having a plurality of openings 735 (e.g., one for each capacitive coupling element 721) forms a grid-like shape, as discussed above.

FIG. 7C shows the unit cell structures 701, 721 of FIGS. 7A and 7B arranged on top of each other. It should be noted that the layer 731 forming a part of the active antenna module was not previously shown in FIG. 7A for clarity of presentation. Said layer 731 may correspond to a radome of the active antenna module while the layer 732 corresponds to the radome of the passive antenna module (similar to FIG. 7B).

Moreover, FIG. 7C further shows an electromagnetic directing element 726 (made of a metal or an alloy) in the form of a rectangular metallic patch arranged over the capacitive coupling element 721. This metallic directing element 726 is employed here to tune the S11 parameter (i.e., the reflection coefficient) of the second antenna element 705 of the active antenna module. Other shapes for this element 726 may be used in other embodiments.

The exemplary structures shown in FIGS. 7A, 7B and 7C may have, for example, the following dimensions for enabling operation at a frequency band of 3.2 to 3.8 GHz.

- The distance between the ground plane 702 and the crossed dipole antenna element 705 is 28 mm.
- The dimensions of the mouth of the cup-like set of walls 703 are 40 mm×40 mm.
- The lateral dimensions of the whole unit cell structure 701 (i.e., the periods of the second antenna array of the active antenna module in two orthogonal directions) are 42 mm×58 mm.
- The thickness of the radome layer 731 of the active antenna module is 2 mm.
- The thickness of the radome layer 732 of the passive antenna module is 2 mm.
- The walls 722 surrounding the capacitive coupling element 721 have a height of 10 mm and lateral dimensions of 40 mm×40 mm.
- The electromagnetic directing element 726 has the dimensions 27 mm×27 mm and is placed at a distance of 25 mm from the radome layer 732 of the passive antenna module.
- Each dipole arm of each bottom crossed dipole element 723 of the capacitive coupling element 721 has the length of 15 mm and a maximum width of 5 mm (width being the dimension orthogonal to the longitudinal direction of the dipole arm).
- Each dipole arm of each top crossed dipole element 725 of the capacitive coupling element 721 has the length of 15 mm and a maximum width of 5 mm (width being the dimension orthogonal to the longitudinal direction of the dipole arm).

As used in this application, the term "circuitry" may refer to one or more or all of the following:

(a) hardware-only circuit implementations (such as implementations in only analog and/or digital circuitry) and (b) combinations of hardware circuits and software, such as (as applicable):

(i) a combination of analog and/or digital hardware circuit (s) with software/firmware and (ii) any portions of hardware processor(s) with software (including digital signal processor(s)), software, and memory(ies) that work together to cause an apparatus, such as a mobile phone or server, to perform various functions) and (c) hardware circuit(s) and or processor(s), such as a microprocessor(s) or a portion of a microprocessor(s), that requires software (e.g., firmware) for operation, but the software may not be present when it is not needed for operation.

This definition of circuitry applies to all uses of this term in this application, including in any claims. As a further example, as used in this application, the term circuitry also covers an implementation of merely a hardware circuit or processor (or multiple processors) or portion of a hardware circuit or processor and its (or their) accompanying software and/or firmware. The term circuitry also covers, for example and if applicable to the particular claim element, a baseband integrated circuit or processor integrated circuit for a mobile device or a similar integrated circuit in server, a cellular network device, or other computing or network device.

Even though the invention has been described above with reference to an example according to the accompanying drawings, it is clear that the invention is not restricted thereto but can be modified in several ways within the scope of the appended claims. Therefore, all words and expressions should be interpreted broadly and they are intended to illustrate, not to restrict, the embodiment. It will be obvious to a person skilled in the art that, as technology advances, the inventive concept can be implemented in various ways. Further, it is clear to a person skilled in the art that the described embodiments may, but are not required to, be combined with other embodiments in various ways.

The invention claimed is:

1. A passive antenna module for an active-passive antenna system, the passive antenna module comprising:

a chassis for detachably mounting onto an active antenna module of the active-passive antenna system, wherein the chassis comprises an opening or a cavity for extending at least partially over the active antenna module when the chassis is mounted onto the active antenna module;

a ground plane layer arranged within or over said opening or cavity and fixed to the chassis, wherein the ground plane layer comprises at least a metallic or metallized grid;

a first antenna array comprising one or more first antenna elements arranged, in part, over said chassis and adjacent to said opening or cavity and, in part, over said opening or cavity, wherein the chassis and the ground plane layer are adapted to act as ground planes for the first antenna array; and one or more electromagnetic coupling elements arranged over the ground plane layer for coupling electromagnetic radiation received from the active antenna module via the ground plane layer to free space when the chassis is mounted onto the active antenna module; and/or one or more electromagnetic waveguiding elements arranged over the ground plane layer for guiding electromagnetic radiation received from the active antenna module via the ground plane layer to free space when the chassis is mounted onto the active antenna module.

2. The passive antenna module of claim 1, wherein the ground plane layer further comprises a two-dimensional array of metallic patches arranged within the metallic or metallized grid.

3. The passive antenna module of claim 1, wherein both the chassis and the opening or cavity have a shape which is elongated along the same direction and the one or more first antenna elements are arranged to be at least partially adjacent to one or more longitudinal sides of the opening or cavity.

4. The passive antenna module according to claim 1, wherein the one or more first antenna elements are resonant antenna elements of equal geometry and dimensions and/or the first antenna array is a one- or two-dimensional planar array with uniform antenna spacing.

5. The passive antenna module according to claim 1, wherein the passive antenna module is adapted so that the first antenna array is arranged substantially at a distance of a first wavelength divided by four from both the chassis and the ground plane layer, said first wavelength being a wavelength corresponding to a frequency within a first operational frequency band of the first antenna array.

6. The passive antenna module according to claim 1, wherein a largest dimension of a unit cell of the metallic or metallized grid is smaller than a second wavelength divided by eight, by nine, by ten or by eleven, said second wavelength being a wavelength corresponding to a frequency within a first operational frequency band of the first antenna array.

7. The passive antenna module according to claim 1, further comprising:

a printed circuit board arranged within or over said opening or cavity and fixed to the chassis, wherein the ground plane layer is implemented as a metallized pattern on a surface of said at least one printed circuit board with an opposing surface to said surface being bare.

8. The passive antenna module according to claim 1, wherein the passive antenna module comprises the one or more electromagnetic coupling elements further comprises:

one or more metallic walls surrounding at least one of the one or more electromagnetic coupling elements for further guiding the electromagnetic radiation received from the active antenna module and/or a metallic electromagnetic directing element arranged over the one or more electromagnetic coupling elements for reducing reflections.

9. The passive antenna module according to claim 1, wherein the passive antenna module comprises the one or more electromagnetic waveguiding elements, the one or more electromagnetic waveguiding elements comprising one or more hollow metallic waveguides and/or one or more dielectric waveguides.

10. An active-passive antenna system comprising:

a passive antenna module according to adapted to operate at least at a first operational frequency band; and an active antenna module onto which the passive antenna module is detachably mounted, wherein the active antenna module comprises:

a second antenna array adapted to operate at a second operational frequency band higher than the first operational frequency band, wherein the ground plane layer of the passive antenna module is adapted to be transparent or semitransparent at the second operational frequency band.

11. The active-passive antenna system of claim 10, wherein said opening or cavity of the chassis of the passive antenna module is adapted to extend at least over the second antenna array of the active antenna module or over the active antenna module as a whole.

12. The active-passive antenna system according to claim 10, wherein no wired electrical connection is provided between the passive antenna module and the active antenna module.

13. The active-passive antenna system according to claim 10, wherein the second antenna array is a planar two-dimensional antenna array with uniform antenna element spacing and/or a largest dimension of a unit cell of the metallic or metallized grid is larger than a third wavelength divided by four or by three, said third wavelength being a wavelength corresponding to a frequency within the second operational frequency band of the second antenna array.

* * * * *